United States Patent [19]

Nixon

[11] Patent Number: 4,695,764

[45] Date of Patent: Sep. 22, 1987

[54] DISPLAY ARRANGEMENTS

[75] Inventor: Ralph D. Nixon, Braintree, England

[73] Assignee: English Electric Valve Company Limited, Chelmsford, England

[21] Appl. No.: 637,035

[22] Filed: Aug. 2, 1984

[30] Foreign Application Priority Data

Aug. 5, 1983 [GB] United Kingdom ..... 8321147

[51] Int. Cl.[4] ..... H01J 1/62

[52] U.S. Cl. ..... 313/497; 313/495; 313/426

[58] Field of Search ..... 313/495, 496, 497, 426, 313/427, 431, 432

[56] References Cited

U.S. PATENT DOCUMENTS

| | | | |
|---|---|---|---|
| 2,623,190 | 12/1952 | Roth | 313/432 |
| 3,694,686 | 9/1972 | Harao et al. | 313/427 |
| 4,243,986 | 1/1981 | Nixon | 313/497 |

FOREIGN PATENT DOCUMENTS

| | | | |
|---|---|---|---|
| 0121262 | 9/1980 | Japan | 313/496 |
| 434868 | 9/1935 | United Kingdom . | |
| 723174 | 2/1955 | United Kingdom . | |
| 0723174 | 2/1955 | United Kingdom . | |
| 882866 | 11/1961 | United Kingdom . | |
| 900431 | 7/1962 | United Kingdom . | |
| 2057187E | 8/1983 | United Kingdom . | |

*Primary Examiner*—David K. Moore

*Attorney, Agent, or Firm*—Spencer & Frank

[57] ABSTRACT

A display arrangement consists of a tubular envelope with fluorescent stripes running along its length, localized portions of which are illuminated by different electron guns which produce flood beams of electrons. Each gun is situated within a switchable magnetic field which determines the angular direction at which the flood beam leaves the gun, and hence which one of the fluorescent stripes is caused to emit light. The stripes can be of three different primary colors, to produce a colored display.

21 Claims, 2 Drawing Figures

DISPLAY ARRANGEMENTS

BACKGROUND AND SUMMARY OF THE INVENTION

This invention relates to display arrangements which are capable of producing bright, readily alterable displays.

According to this invention, a display arrangement includes an evacuated envelope having a fluoroscent screen and an electron gun which is capable of producing a flood beam of electrons which falls upon said screen, the screen having three distinct adjacent localized areas which emit light of three different primary colors respectively in response to incident electrons, the electron gun comprising a cathode and a field electrode positioned adjacent to the cathode and arranged to shape the flood beam which emerges from said gun, the three localized areas of the screen being such that the undeflected flood beam falls upon one of them; means for generating a predetermined magnetic field in the region of said gun, the angle at which said beam emerges from said gun being dependent upon the polarity of the magnetic field so that said beam is deflected to fall upon the other two localized areas respectively in response to a magnetic field of the same value but of opposite polarity.

Three different localized areas of the screen can be associated with a particular flood beam and each of these areas carries a different color phosphor, e.g. red, green, blue, so that by altering the angle at which the beam emerges from the gun the color of the display can be changed. Preferably, a mesh electrode is positioned between the screen and the gun and carries a relatively low potential so that the customary very high potential which is applied to the screen does not influence the operation of the gun.

DESCRIPTION OF A PREFERRED EMBODIMENT

Figure 1:
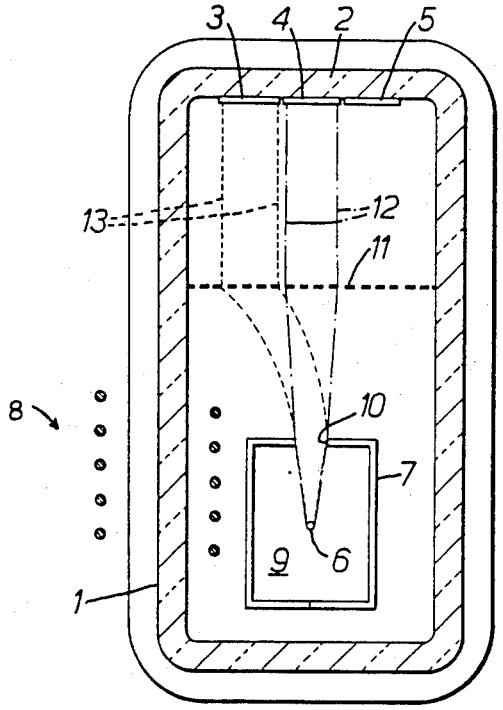
FIG. 1 illustrates a cross-sectional view of a display arrangement in accordance with the present invention.

Referring to the drawing, the display arrangement consists of a long glass tubular envelope 1 of approximately rectangular cross-section, a portion of which constitutes a fluorescent screen 2, and carries three longitudinal stripes 3, 4 and 5 of red, green and blue phosphor respectively. The envelope is sealed at both ends (not shown) and is evacuated to a high level of vacuum. A single elongate cathode 6 is positioned towards the end of the rectangular section of the envelope which is away from the screen 2 and the cathode 6 is almost entirely enclosed by means of a field electrode 7. The field electrode 7 and the cathode 6 constitute an electron gun 9 which is arranged to produce a flood beam of electrons, the width of which is determined primarily by the opening 10 in the field electrode 7. A mesh electrode 11 is positioned between the electron gun and the screen 2.

In operation, emission of electrons from the electron gun can be controlled by the potential applied to the field electrode 7 with respect to the cathode 6. By controlling the angle at which the electron beam emerges from the gun, it can be caused to strike just one of the three stripes, 3, 4 or 5 so that a red, green or blue display can be selected at will. In FIG. 1 the trajectory of the electron beam when no lateral deflection is applied to it, is illustrated in chain line 12. In this instance, it strikes the green stripe 4 and produces a correspondingly colored patch of intense illumination. Under these conditions, typical voltages are as follows. A very high potential is applied to the inner surface of the screen 2 and is typically about +7 KV. The mesh electrode 11 is held at +10 V and the field electrode 7 is held at the potential of +10 V also. All potentials are with respect to the nominal earth potential of the cathode 6. Under the conditions in which the stripe 4 is illuminated by the electron beam, no magnetic field is applied to the display arrangement. The electrons are emitted from the cathode 6 towards the mesh electrode 11 in a direction which is transverse to the run of the cathode 6. It will be noted that the width or spread of the flood beam is dictated by the width of the opening 10 and that the flood beam electron continues to diverge in an almost linear manner until it reaches the mesh electrode 11 which is held at +10 V. When the electrons reach the mesh electrode 11, they are greatly influenced by the very high potential on the screen 2 and are accelerated in a very rapid manner so as to strike the phosphor 4 with high energy.

In practice, the brightness of the display can be determined by pulse width modulation of the potential on the field electrode 7. In this case, the cathode is a directly heated filament, that is to say its temperature is raised to that at which copious emission of the electrons takes place by passing an electric current through it. The resistance of the filament is chosen so as to provide the required temperature rise. By pulsing the current along the filament, instead of passing it continuously, the variation of potential along the filament can be prevented from causing brightness variations across the screen. Thus, the current pulses are applied to the filament only while the electron beam is not permitted to emerge from the electron gun. The device is turned off, i.e. the electron beam is contained within the electron gun by applying a potential of −2 V to the field electrode 7, instead of the normal potential of +10 V. The pulse repetition rate of the pulses applied to the field electrode should be well above the flicker threshold of the eye, so that an observer can see a continuously present display.

Figure 2:
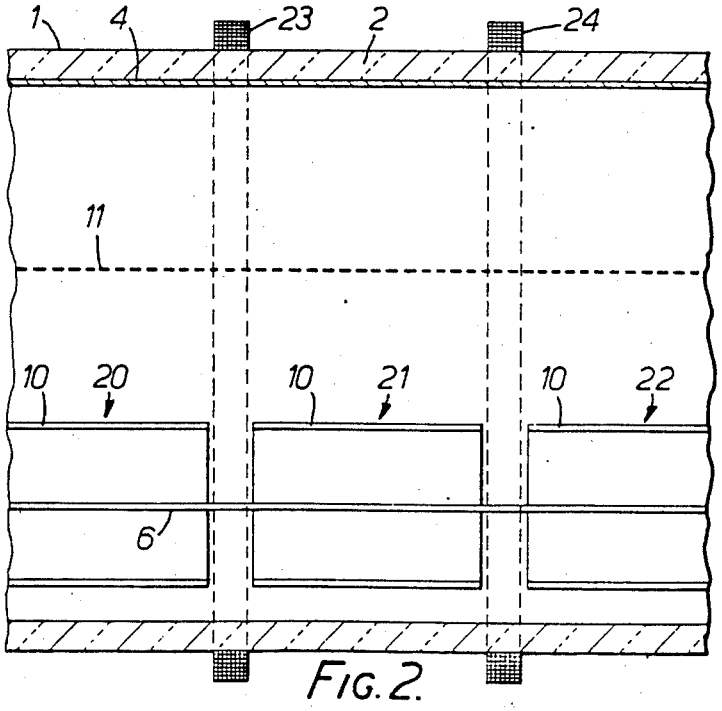
FIG. 2 is a longitudinal section view.

With reference to FIG. 2 it will be noted that the envelope 2 is of an elongate nature and that a number of separate electron guns 20, 21 and 22 are positioned along the length of the single continuous filamentary cathode 6. The electron guns are spaced apart slightly from each other and at each of these positions an external electric coil 23 and 24 is positioned (only two coils are shown, but in practice a large number of guns and coils could be provided). These constitute electro-magnets which produce a strong magnetic field when current is passed through them. The direction of the magnetic field is along the length of the filament and the polarity of the magnetic field is altered by changing the direction of current flow. In practice all coils will be arranged to produce a magnetic field of the same polarity at particular instants of time.

Conveniently, the same source of power can be used to heat the cathode and to energize the electro-magnetic coils, the coils being energised during intervals between heater pulses, since it is only during the intervals that the electron beam is allowed to emerge from the gun.

When it is desired to illuminate a different one of the phosphor stripes, for example, red, all of the previously stated potentials which were applied while a green patch of light was produced, remain the same and a magnetic field is applied to the electrons as they leave the cathode. In FIG. 1, the magnetic field is assumed to be into the paper and is represented diagramatically by the small circles 8. A typical magnetic field strength is about 5 oersteds. The resulting electron beam trajectory is indicated by the broken line 13. The electrons are not greatly deflected in the magnetic field in the region between the mesh electrode 11 and the screen 2 as they are moving very rapidly indeed, but if necessary, the mesh electrode can be positioned closer to the screen 2 to ensure that only the phosphor of the correct color is radiated by the incident electrons.

It will be noted that it is not necessary to selectively adjust the amplitude or strength of the magnetic field in order to produce a particular colour. The device operates in a binary manner, that is to say, a predetermined field strength of one polarity or the other is applied if the red or blue patches of color are required, whereas no field is applied if a green illumination is required.

Thus, in practice, a sequence of positive magnetic field, negative magnetic field, and no magnetic field is applied by all of the magnetic coils in steps. If that color corresponding to the step in the sequence is required to be illuminated, then a potential of +10 V is applied to the field electrode 7 in synchronism—if that particular colour is not required, then a potential of −2 V is applied to inhibit electron emission.

A large number of the display arrangements, each having a large number of separate controllable electron guns, can be mounted side by side to produce a large two-dimensional display area with extremely good optical resolution and control over the individual pixels in the display.

What I claim is:

1. A display arrangement including an evacuated envelope having a fluorescent screen and an electron gun which is capable of producing a flood beam of electrons which falls upon said screen, the screen having three distinct adjacent localized areas which emit light of three different primary colors respectively in response to incident electrons, the electron gun comprising a cathode and a field electrode positioned adjacent to the cathode and arranged to shape the flood beam which emerges from said gun, the three localized areas of the screen being such that the undeflected flood beam falls upon one of them; means for generating a predetermined magnetic field in the region of said gun, the angle at which said beam emerges from said gun being dependent upon the polarity of the magnetic field so that said beam is deflected to fall upon the other two localized areas respectively in response to a magnetic field of the same value but of opposite polarity.

2. A display arrangement as claimed in claim 1 and wherein the flood beam is shaped in relation to the size of the three localized areas such that it is capable of falling wholly upon just one of the areas at a time.

3. A display arrangement as claimed in claim 1 and wherein the envelope is of an elongate tubular shape with a plurality of separate electron guns positioned along its length.

4. A display arrangement as claimed in claim 3 and wherein the plurality of electron guns share a common filamentary cathode.

5. A display arrangement as claimed in claim 1 and wherein three fluorescent stripes run longitudinally along the length of the elongate envelope with portions of the different stripes constituting said selected localized areas.

6. A display arrangement as claimed in claim 1 and wherein a mesh electrode is positioned between the screen and the cathode.

7. A display arrangement as claimed in claim 5 and wherein three contiguous parallel stripes are positioned in relation to the electron gun so that the central stripe is radiated by an undeflected flood beam, and the two outer stripes are respectively radiated by the flood beam when it is subjected to a predetermined magnetic field strength of one polarity or the other.

8. A display arrangement as claimed in claim 1 and wherein the means for generating the magnetic field comprises a plurality of electro-magnetic coils, each of which encircles the envelope, with each coil being positioned adjacent to the end of an electron gun.

9. A display arrangement, comprising:

an evacuated envelope having a screen that is disposed in a plane, the screen having first, second, and third localized areas which emit light of three different primary colors respectively in response to incident electrons, the screen being maintained at a positive high voltage;

a cathode disposed in the envelope at a position spaced apart from the screen;

a mesh electrode between the cathode and the screen and spaced apart from the cathode and the screen, the mesh electrode being disposed in a plane that is parallel to the plane of the screen and being maintained at a positive voltage that is substantially less than the voltage of the screen, the mesh electrode including a first region corresponding to the first localized area of the screen, so that a line perpendicular to the plane of the screen at the first localized area passes through the first region of the mesh electrode, a second region corresponding to the second localized area of the screen, so that a line perpendicular to the plane of the screen at the second localized area passes through the second region of the mesh electrode, and a third region corresponding to the third localized area of the screen, so that a line perpendicular to the plane of the screen at the third localized area passes through the third region of the mesh electrode;

field electrode means disposed around the cathode for emitting a flood beam of electrons toward the mesh electrode and for selectively switching the flood beam on and off, the flood beam being dimensioned to fall on a single region of the mesh electrode and being directed toward the second region thereof unless it is deflected; and magnetic beam deflection means for selectively deflecting the flood beam of electrons to the first region of the mesh electrode when the deflection means is energized in a first state and for selectively deflecting the flood beam of electrons to the third region of the mesh electrode when the deflection means is energized in a second state.

10. A display arrangement as claimed in claim 9, wherein the first, second, and third localized areas of the screen comprise first, second, and third fluorescent stripes having axes that are parallel to one another, each stripe having a width that is substantially the same as the width of the flood beam of electrons.

11. A display arrangement according to claim 9, wherein the cathode comprises an elongated filament having an axis that is parallel to the plane of the screen.

12. A display arrangement according to claim 9, wherein the magnetic beam deflection means comprises a coil around the envelope.

13. A display arrangement according to claim 9, wherein the cathode is maintained at ground potential, wherein the field electrode means is selectively maintained at a positive voltage to switch the flood beam of electrodes on and at a negative voltage to switch the flood beam of electrons off, wherein the screen is maintained at a positive voltage in the kilovolt range, and wherein the mesh electrode is maintained at a positive voltage that is less than a hundredth of the screen voltage.

14. A display arrangement according to claim 9, wherein the envelope is elongated and has an axis that is parallel to the plane of the screen and the plane of the mesh electrode, wherein the first, second, and third localized areas of the screen comprise first, second, and third fluorescent stripes having axes that are parallel to the axis of the envelope, wherein the cathode comprises an elongated filament having an axis that is parallel to the axis of the envelope, and further comprising a plurality of additional field electrode means that are disposed along the filament, and a plurality of respective additional magnetic beam deflection means.

15. A display arrangement as claimed in claim 1 and wherein the cathode comprises a substantially straight filament which is disposed within and substantially surrounded by the field electrode.

16. A display arrangement as claimed in claim 1 and wherein the flood beam is shaped by the electron gun in relation to the size of the three localized areas such that it is capable of falling wholly upon just one of the areas at a time.

17. A display arrangement as claimed in claim 1 and wherein the envelope is of an elongated tubular shape with a plurality of separate electron guns positioned along its length, each electron gun producing a respective flood beam of electrons, and wherein the electron guns share a common filamentary cathode.

18. A display arrangement as claimed in claim 8 and wherein the cathode comprises a substantially straight filament having a filament axis and wherein the electromagnetic coils are substantially coaxially disposed and have a common coil axis, the filament axis and coil axis being substantially parallel.

19. A display arrangement according to claim 9, wherein the field electrode means is a hollow conductive element within which the cathode is disposed.

20. A display arrangement according to claim 12, wherein the cathode comprises a substantially straight filament having a filament axis and wherein the coil has a coil axis, the coil axis being substantially parallel to the filament axis.

21. A display arrangement according to claim 14, wherein each additional field electrode means emits a respective flood beam of electrons that is dimensioned to fall on a single region of the mesh electrode.

* * * * *